United States Patent [19]

Lörsch

[11] Patent Number: 4,787,766

[45] Date of Patent: Nov. 29, 1988

[54] STORAGE POCKET ARRANGEMENT FOR FILM MATERIAL AND APPARATUS FOR INTRODUCING FILM MATERIAL THEREINTO

[76] Inventor: Johannes Lörsch, An Der Bleiche 49, D-4172 Straelen, Fed. Rep. of Germany

[21] Appl. No.: 79,689

[22] Filed: Jul. 30, 1987

[30] Foreign Application Priority Data

Aug. 18, 1986 [DE] Fed. Rep. of Germany ..... 3627955

[51] Int. Cl.[4] ..... B42D 15/00; B65B 5/10

[52] U.S. Cl. ..... 402/79; 53/520

[58] Field of Search ..... 53/520; 281/20; 402/79

[56] References Cited

U.S. PATENT DOCUMENTS

| | | | |
|---|---|---|---|
| 2,986,144 | 5/1961 | Shepard | 281/20 |
| 3,872,645 | 3/1975 | Dorman | 53/520 |
| 4,099,362 | 7/1978 | Dorman | 53/520 |

*Primary Examiner*—Paul A. Bell

*Attorney, Agent, or Firm*—Mason, Kolehmainen, Rathburn & Wyss

[57] ABSTRACT

A storage pocket arrangement for film material, which can be stored in a file, ring binder or the like, has a plurality of individual pockets in superposed or juxtaposed relationship, in a substantially flat configuration, for accommodating respective film strips therein. The arrangement has a strip portion arranged along an edge thereof, which includes punched holes or the like for storing the pocket arrangement in a file, ring binder or the like. The strip portion has additional markings to permit the storage pocket arrangement to be used in an apparatus for introducing the film strips into the respective individual pockets, in a cyclic mechanized procedure. An apparatus for introducing strips of film material into the respective pockets of the storage pocket arrangement includes a particular transportation means for transporting the storage pocket arrangement, means for introducing film strip into the respective pockets, and means for sensing markings on the storage pocket arrangement to provide cyclic operation of the apparatus.

6 Claims, 3 Drawing Sheets

STORAGE POCKET ARRANGEMENT FOR FILM MATERIAL AND APPARATUS FOR INTRODUCING FILM MATERIAL THEREINTO

BACKGROUND OF THE INVENTION

The invention relates generally to a storage pocket arrangement for storing film material, and more particularly such a storage pocket arrangement which can be filed away in a storage system such as a storage file, ring binder or the like.

The invention also relates to an apparatus for introducing film material into a storage pocket arrangement, in individual pockets therein.

Storage pocket arrangements for film material, which can be suitably stored away in various kinds of storage systems, generally comprise a plurality of individual pockets which are arranged in juxtaposed or superposed relationship in a flat sheet-like article. Film strips consisting of negative or positive film material are fitted into the respective pockets in the storage pocket arrangement by the person using same, by a manual operation. It is also known for film strips, after treatment or processing, for example after a development operation, to be fitted into storage pockets by machine. However the procedure does not involve storage pocket arrangements which can be filed away in a storage filing system, but rather the film strips are introduced into pockets defined between a foil assembly, which can be drawn off a supply roll, the foil assembly comprising two sheets of foil material which are arranged one above the other and which are preferably transparent and which are connected together, for example by welding, at spaced-apart positions, transversely with respect to the longitudinal direction of the foil assembly, thereby forming between the regions in which the sheets of foil are connected together, pockets into which the film material can be inserted from the side in a machine operation. For that purpose the web of foil material may be transported by means of transportation rollers on a suitable support surface. Arranged laterally of the support surface, and stationary with respect thereto, is a station for introducing the film strips into the pockets. The transportation movement is effected cyclically by the width of a pocket in each phase, and a film strip is then cyclically introduced into the respective 'empty' pocket which is disposed in opposite relationship to the station for introducing the film strip. The film strip is then cut off at its end, after it has been put into the appropriate pocket.

The web of foil material is then moved on by the width of one pocket and the above-outlined procedure is repeated. A film generally fils a number of mutually adjoining individual pockets, in that manner.

As the film strips which are put into storage pockets in that way cannot be bound in a storage file, ring binder or the like, for archive storage purposes, the usual practice is for the user to remove the film material from the pocket assembly and then introduce it into the individual pockets of a storage pocket arrangement by a manual operation, as first outlined above, thereby to provide for archive storage thereof.

It will be seen therefore that the above-indicated mode of operation is a complicated and costly one and moreover the possibility of damage to the film material cannot be entirely excluded.

SUMMARY OF THE INVENTION

An object of the invention is to provide an archive-storable storage pocket arrangement for film material, which is adapted to permit film material to be introduced for storage therein, by machine.

Another object of the present invention is to provide a storage pocket arrangement for storing strips of film material therein, adapted to permit film strips to be introduced thereinto by a simple operating procedure.

Yet another object of the present invention is to provide an apparatus for introducing strips of film material into an archivestorable storage pocket arrangement, which operates in a simple ad reliable manner in cooperation therewith.

In accordance with the present invention, in a first aspect, these and other objects are achieved by an archive-storable storage pocket arrangement for film material comprising a plurality of individual pockets or compartments arranged in substantially contiguous relationship, being for example juxtaposed or superposed, in a flat article, for accommodating respective film strips, and a strip portion which is arranged along an edge of the storage pocket arrangement and including means for storage filing thereof such as punched holes for storage in storage files, ring binders or the like. The strip portion at an edge of the arrangement has marks which can be suitable recognised and detected, for example by mechanical, optical, electrical or magnetic means, being disposed at spacings which are adapted to the width of each said individual pocket, for the purposes of cyclic transportation of the storage pocket arrangement in an apparatus for introducing film strip into the respective pockets.

That configuration permits storage pocket arrangements to be cyclically transported in a suitable designed apparatus for inserting film strips into the respective pockets, in such a way that, when a given pocket has been filled with a respective film strip, the storage pocket arrangement can be advanced through the apparatus by the width of an individual pocket.

The marks may be formed for example by stampings or punchings, printed marks or recording means for a magnetic strip.

In an embodiment of the storage pocket arrangement according to the invention, it may include a recognition or detection marking means suitable for detecting the size of the individual pockets in the arrangement. By use of such marking means, a suitably designed apparatus for introducing film strips into the respective pockets can detect whether the pocket width corresponds to the respective film size as set at the apparatus. If the pocket size does not conform with the set film size, then the storage pocket arrangement is rejected and the apparatus will not try to insert film strip into the respective pockets. That can ensure for example that a film strip of a format size measuring 6×9 cm cannot be put into the pocket of a storage pocket arrangement designed to accommodate a smaller film format, which could cause damage to either the pocket arrangement or the film or both.

In another advantageous feature of the invention, the strip portion is arranged at the edge of the pocket arrangement which has openings for introducing film strips into the individual pockets.

In another aspect of the present invention, apparatus for introducing film material into a storage pocket arrangement of the above-indicated kind in accordance with the invention comprises a means defining a surface or plane for carrying and transporting the storage pocket arrangement, and a means for introducing strips of film material into the respective pockets, said introducing means being arranged at a stationary location relative to the support surface. The introducing means performs a movement for introducing film strip into the pockets, which is transverse with respect to the direction of transportation of the film material. The apparatus further includes a transportation slot extending in the direction of transportation movement of the storage pocket arrangement, in front of the film strip-introducing means, and a transportation means which is adapted to engage a bent-over or folder-over edge region of a said storage pocket arrangement, preferably a bent-over or folder-over edge region of the strip portion of the storage pocket arrangement, as referred to above.

The folded-over or bent-over edge region is thus arranged to extend through the slot and engaged by the transportation means to provide for transportation of the pocket arrangement through the apparatus.

The transportation slot is preferably arranged along the boundary of the support surface, which is towards the film strip-introducing means.

The fact of the bent-over or folded-over edge region of the storage pocket arrangement being passed through the slot and then drivingly engaged by the transportation means provides that the apparatus has a stabilising effect on the storage pocket arrangement, both during the cyclic forward feed movement thereof and also during the actual operation of introducing the film strip material into the respective pockets of the storage pocket arrangement, for the pocket arrangement cannot slip away during that film-introducing operation as it is held firmly at the bent-over edge region, which is precisely the location where the forces produced in introducing the film strip into the storage pocket arrangement are applied to the arrangement. A further advantage of this configuration is that the viewing conditions are particularly good in the region in which the film strips are introduced into the storage pocket arrangement, as that region is notmasked or hidden by conveyor devices or the like, insofar as the transportation means for transporting the storage pocket arrangement is disposed on the other side of the support surface from the storage pocket arrangement; as will be seen hereinafter, the transportion means may be disposed underneath the support surface on which the storage pocket arrangement is movably carried, with the bent-over edge region of the arrangement extending downwardly through a slot at the edge of the support surface, to be engaged by the transportation means.

The film strip-introducing means further includes a recognition means for detecting recognition marking indicating the size of the individual pockets of the storage pocket arrangement. The film stripintroducing means is also operable to detect the marks on the storage pocket arrangement and to provide for cyclic transportation thereof, in conformity with the mode of operation of the introducing means.

Further objects, features and advantages of the present invention will be apparent from the following description of preferred embodiments thereof.

DESCRIPTION OF THE PREFERRED EMBODIMENTS

Figure 1:
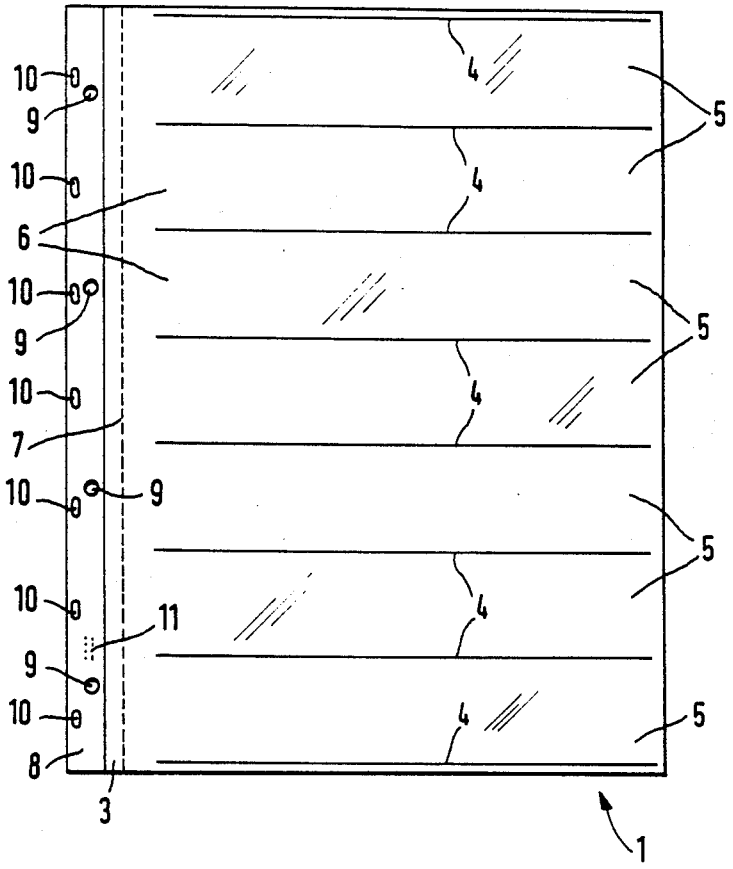
FIG. 1 is a plan view of a storage pocket arrangement according to the invention.
Figure 2:
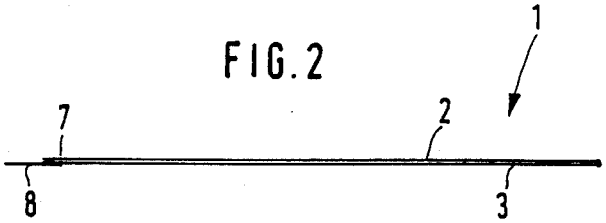
FIG. 2 is an end view of a pocket arrangement as shown in FIG. 1.

Referring firstly to FIGS. 1 and 2, a storage pocket arrangement 1 for film material, which is suitable for archive storage such as in a storage file, ring binder or the like, comprises two foils 2 and 3 which are arranged in superposed relationship to form a flat sheet-like articles, as can be clearly seen from FIG. 2. At spaced-apart locations in the longitudinal direction thereof, as considered from top to bottom in FIG. 1, the arrangement 1 has joins or connections as indicated at 4 which connect the two foils 2 and 3 together along transversely extending lines. The joins 4 are produced for example by the foils 2 and 3 being suitably welded together at those locations. Thus, formed between the join lines 4 are individual pockets 5 into which film material strips can be introduced from the left-hand side in FIG. 1, by means of suitable openings are indicated at 6.

It will be noted that, in order to facilitate the operation of introducing film strips into the respective openings 6 and thus into the pockets 5, the join lines 4 are not extended right to the left-hand edge in FIGS. 1 and 2, thus leaving an edge region indicated at 7 in FIG. 2, in which the two foils 2 and 3 are not joined together. The edge region 7 can be suitably lifted to facilitate the operation of introducing film material into the pockets, as will be seen in greater detail hereinafter in relation to the description of the apparatus as illustrated for example in FIG. 4.

Disposed on the storage pocket arrangement 1 along the lefthand edge thereof as shown in FIGS. 1 and 2 is a strip portion 8 which is provided with openings or punched holes 9 at spacings from each other in the longitudinal direction of the strip portion 8. The strip portion 8 comprises for example strong paper or the like, thus affording the possibility, as mentioned above, of binding the storage pocket arrangement 1 in a storage filing system such as a storage file, ring binder or the like.

The strip portion 8 further has spaced-apart marks 10 which are arranged at spacings which match the width of the individual pockets 5. In the illustrated embodiment the marks 10 are also in the form of openings or punched holes.

The strip portion 8 further has a recognition marking 11 which is suitable for automatic recognition of the size of the individual pockets 5 in the storage pocket arrangement in question.

Figure 3:
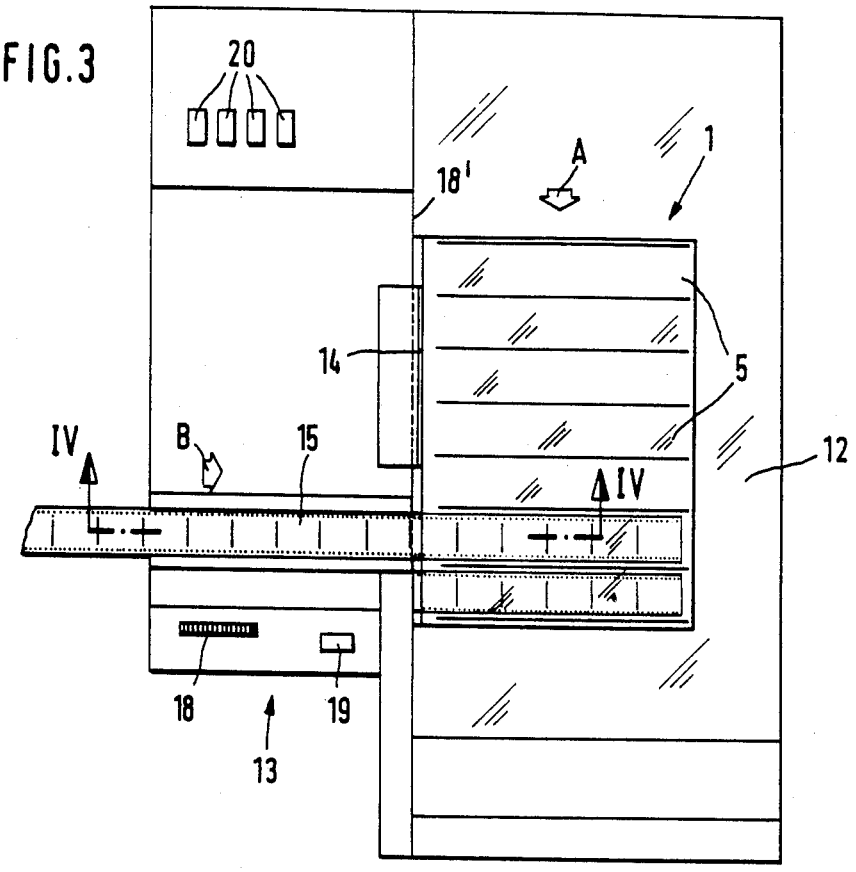
FIG. 3 is a diagrammatic plan view of an apparatus for introducing film material into an arrangement as shown in FIG. 1.
Figure 4:
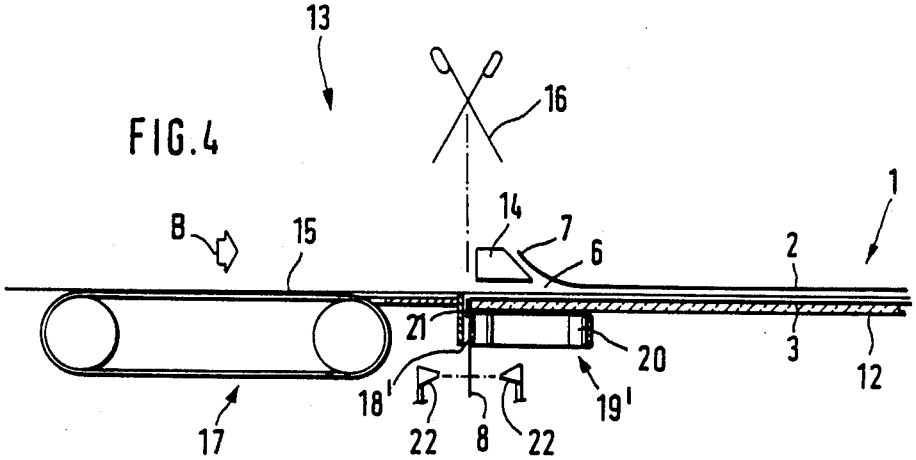
FIG. 4 is a diagrammatic view of the FIG. 3 apparatus in section along line IV—IV therein.
Figure 5:
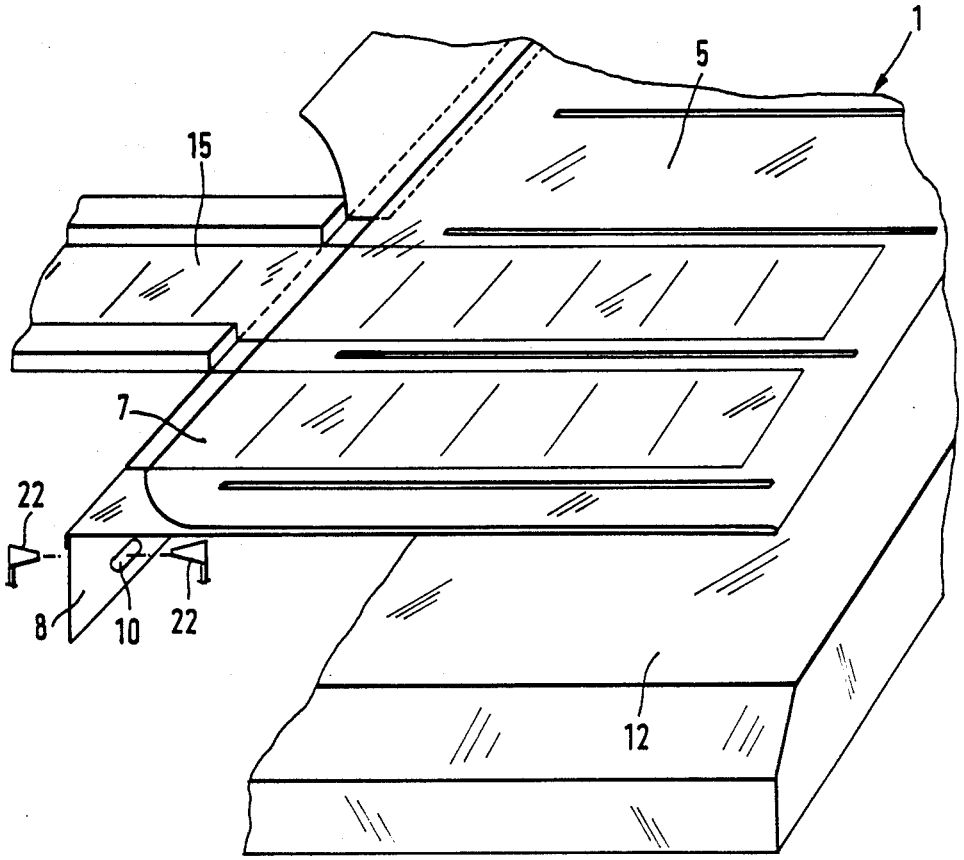
FIG. 5 is a diagrammatic perspective view of a part of the apparatus structure shown in FIG. 3.

Reference will now be made to FIGS. 3-5 showing an apparatus for introducing film material into a storage pocket arrangement 1 as shown in FIGS. 1 and 2. The apparatus comprises a support table 12 providing a support surface on which a storage pocket arrangement 1 can be cyclically advanced in the direction indicated by the arrow A in FIG. 3, and thus moved past a means which is generally indicated by reference numeral 13 in FIGS. 3 and 4, for introducing film strips into the respective pockets.

The apparatus further comprises a guide bar 14 which is of a wedge-like configuration, as can be clearly seen from FIG. 4. The above-mentioned edge region 7 of the foil 2 of the storage pocket arrangement is lifted by the guide bar 14 into the position shown in FIGS. 4 and 5 so that a film strip 15 can be more easily introduced into the pocket opening 6 which is held open in that way, with the movement of the film strip 15 into the respective pocket 5 being in the direction indicated by the arrow B in FIG. 3.

The illustrated apparatus operates in such a way that, after a film strip 15 has been introduced into a pocket, as shown in FIG. 3, the film strip is cut off by means of a cutter which is diagrammatically illustrated at 16. The storage pocket arrangement is then moved cyclically in the direction A until the next empty pocket passes into the region of the film strip-introducing means 13 so that another film strip 15 can in turn be introduced into the appropriate pocket, and so forth.

A drive means 17 for operating the film strip-introducing means is diagrammatically illustrated FIG. 4, in the form for example of an endless conveyor belt engaging the film strip 15 from the underneath thereof.

Appropriate actuating means, lamps and the like are diagrammatically illustrated by reference numerals 18, 19 and 20 in FIGS. 3 and 4.

It will be noted that the film strip-introducing means 13 is of such a design that it can be suitable adjusted and set to film strips with different picture formats.

The apparatus further comprises a transportation slot which is indicated at 18' in FIGS. 3 and 4 and which in the illustrated embodiment extends downwardly substantially at right angles with respect to the support surface 12. The transportation slot 18' extends along the boundary of the support surface 12, which is towards the film strip-introducing means 13. The slot 18' is such that the strip portion 8 of the storage pocket arrangement 1 can be accommodated therein, when an edge region of the storage pocket arrangement 1 has been folded or bent over in the downward direction as viewing in FIG. 4. It will be readily apparent that that imparts a considerable degree of stability to the storage pocket arrangement, by virtue of the bent-over or folded-over configuration thereof, with the bent-over or folded-over edge region thus serving as a reinforcing configuration.

Also disposed in the region of the transportation slot 18' is a transportation means which is generally indicated at 19' and which in the illustrated embodiment is in the form of an endless circulating belt. The left-hand side thereof, as shown in FIG. 4, bears against the strip portion 8 where it projects through the slot 18', while the other side of the strip portion 8 slides against a guide 21 which extends along the side of the slot 18'. In operation of the transportation means 19' the storage pocket 1 is therefore moved in the direction indicated by the arrow A in FIG. 3.

In order now to produce the desired cyclic movement, the apparatus further includes a recognition device 22 which in the illustrated embodiment is an optical device, for recognising the marks 10. A signal to produce the desired cyclic movement of the storage pocket arrangement is produced in that way.

The recognition device 22 may alternatively operate mechanically, electrically or magnetically, when the markings 10 on the storage pocket arrangement 1 are suited to that purpose.

The apparatus may further include another recognition device for recognising the marking 11. The arrangement in that respect is such that, when the picture format as set at the film strip-introducing means 17 does not coincide with the width of the individual pockets 5 of the storage pocket arrangement 1 which is being introduced in the apparatus, transportation of the storage pocket arrangement 1 is prevented.

It will be seen therefore that the above-described storage pocket arrangement and apparatus provide for the introduction of film strips into the pockets by a simple operating procedure, involving appropriate and reliable co-operation between the storage pocket arrangement and the apparatus.

It will be appreciated that the above-described storage pocket arrangement and apparatus have been set forth solely by way of example of the present invention and that various alterations and modifications may be made therein without thereby departing from the spirit and scope of the invention.

What is claimed is:

1. A storage pocket arrangement for film material in combination with an apparatus for automatically inserting film strips into the storage pocket arrangement comprising:

a plurality of individual pockets in substantially contiguous relationship in a substantially flat article, each for accommodating respective film strips, each said individual pocket having a film-receiving opening for receiving said respective film strip adjacent a first edge of said storage pocket arrangement, a strip portion along said first edge of said storage pocket arrangement, holding means on said strip portion for holding the arrangement in an archive-filing system, machine-recognisable marks on said strip portion, said marks spaced apart and corresponding to each said individual pocket, said marks adapted thereby for permitting cyclic transportation of the arrangement in the apparatus for inserting said respective film strips into said individual pockets, and at least one of said marks containing information for identification of the size of said individual pockets, said marks adapted thereby for preventing cyclic transportation of the arrangement in the apparatus for inserting respective film strips into said individual pockets responsive to an identified individual pocket size less than said respective film strip.

2. A storage pocket arrangement as set forth in claim 1 wherein said holding means on said strip portion comprise punched holes disposed at spaced apart locations along said strip portion and spaced from said film-receiving openings said individual pockets.

3. A storage pocket arrangement as set forth in claim 1 wherein said machine-recognisable marks include physical characteristics adapted to be recognized by a mechanical mark reader.

4. A storage pocket arrangement as set forth in claim 1 wherein said machine-recognisable marks include physical characteristics adapted to be recognized by an electrical mark reader.

5. A storage pocket arrangement as set forth in claim 1 wherein said machine-recognisable marks include physical characteristics adapted to be recognized by an optical mark reader.

6. A storage pocket arrangement as set forth in claim 1 wherein said machine-recognisable marks include physical characteristics adapted to be recognized by a magnetic mark reader.

* * * * *